United States Patent [19]

Jacobs et al.

[11] Patent Number: 5,030,068

[45] Date of Patent: Jul. 9, 1991

[54] VIBRATION AND SHOCK DAMPING AIR BLOWER

[76] Inventors: Paul G. Jacobs, 9958 Amestoy Ave., Northridge, Calif. 91324; William H. Williams, 4938 Golden Arrow, Palos Verdes, Calif. 90274

[21] Appl. No.: 408,624

[22] Filed: Sep. 18, 1989

[51] Int. Cl.[5] ..... F04B 39/12

[52] U.S. Cl. ..... 417/363; 417/423.15

[58] Field of Search ..... 34/243 R; 415/213.1, 415/200; 417/363, 360, 423.15

[56] References Cited

U.S. PATENT DOCUMENTS

| | | | |
|---|---|---|---|
| 2,830,752 | 4/1958 | Wentling | 417/363 X |
| 2,927,228 | 3/1960 | Rockafield | 417/423.15 X |
| 2,976,352 | 3/1961 | Atalla | 417/363 X |
| 3,830,595 | 8/1974 | Carpenter et al. | 417/363 |
| 3,874,023 | 4/1975 | Tschudy | 15/326 |
| 4,128,364 | 12/1978 | Papst et al. | 417/363 X |
| 4,161,812 | 7/1979 | Litch, III | 417/363 X |

*Primary Examiner*—Albert J. Makay
*Assistant Examiner*—W. Doerrler
*Attorney, Agent, or Firm*—Kelly, Bauersfeld & Lowry

[57] ABSTRACT

A portable air blower includes a flexibly resilient housing, a motor mounted within the housing, and a blower wheel fixed to a motor shaft. The motor is bolted at one end to a motor mounting bracket which, in turn, is attached to the housing by a plurality of first shock mounts. Each such first shock mount includes a bolt for connecting the motor mounting bracket with the housing, and a resilient elastomeric grommet interposed between the bolt and the bracket. A self-clinching nut fixes the bolt to the housing. The motor shaft rotates through a self-aligning bearing held by a pyramid-like support bracket which is attached to the housing by a plurality of second shock mounts. The second shock mounts are identical to the first shock mounts, and include a resilient elastomeric grommet interposed between the support bracket and the bolt.

14 Claims, 4 Drawing Sheets

FIG. 6
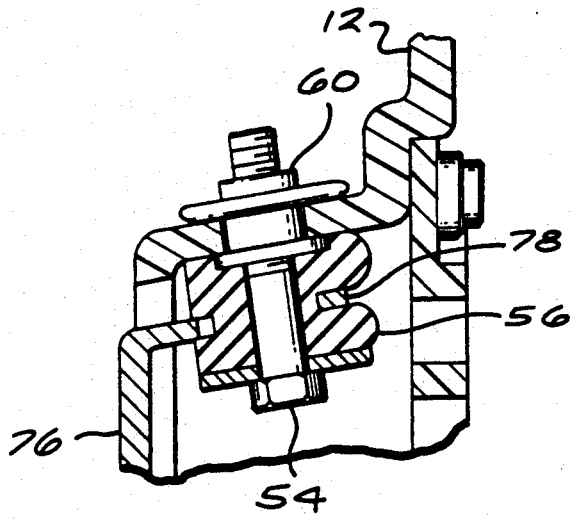
FIG. 7
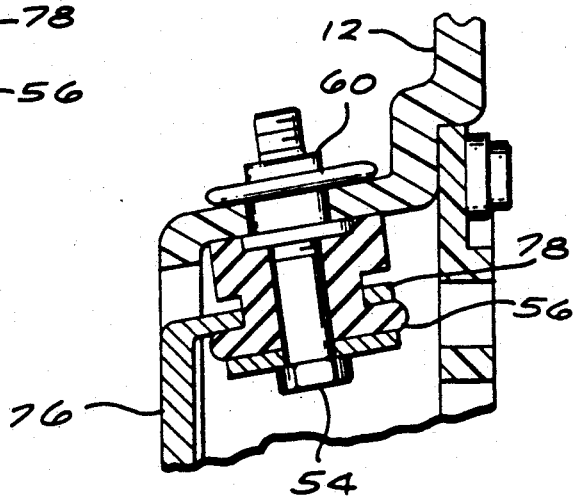
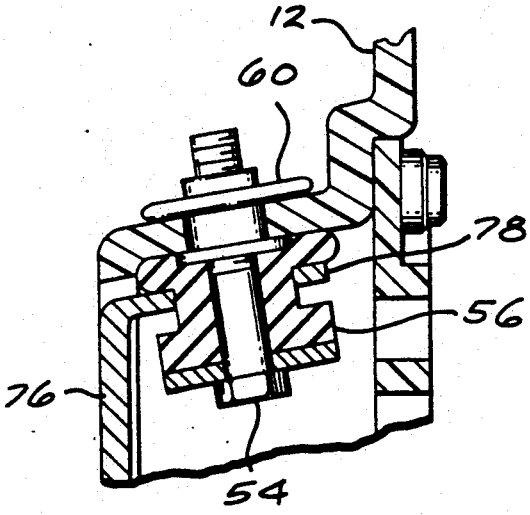
FIG. 8
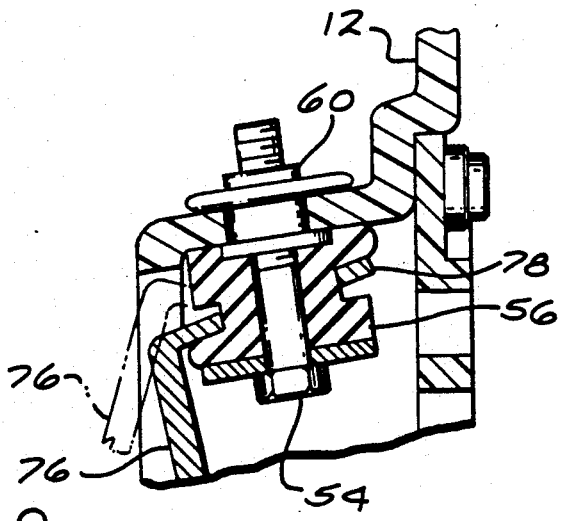
FIG. 9

VIBRATION AND SHOCK DAMPING AIR BLOWER

BACKGROUND OF THE INVENTION

This invention relates generally to portable air blowers often used when drying carpets. More particularly, this invention relates to an air blower having motor driven fan means internally supported by an improved mounting arrangement that absorbs impact-created shock forces and incidental vibration.

Portable air blowers are well known and typically include an electric motor and a blower wheel or fan, which are contained within a housing having an air intake vent and an air exhaust vent. Exemplary of prior devices is the squirrel cage fan air blower, which has drawbacks in common with other prior air blowers. More particularly the squirrel cage fan, as originally developed many years ago, was designed for stationary use only. The squirrel cage fan was not designed for use in portable equipment and, consequently, it was not constructed to withstand the abuse that portable equipment is often subjected to. This is apparent from the structure of a squirrel cage fan, in which the fan is supported by a weak, centrally located, single mounting hub that is insufficient to withstand multi-directional shock forces encountered when portable equipment is dropped or roughly handled while in a running mode. Historically, the life expectancy of squirrel cage fan air blowers has been relatively short.

The problems associated with prior air blowers have arisen due to the very nature of such blowers. In particular, in order to move a high volume of air, the blowers are designed to rotate a large fan or blower wheel as fast as possible within the blower housing. This requires that the motor and the blower wheel be precisely aligned within the housing so as not to create unwanted and possibly destructive vibration.

Portable air blowers are often subjected to rough handling during transportation and in use. Prior designs, characterized by an internal mounting arrangement which rigidly supports the blower means within the housing, attempted to protect the internal air blower components by providing stiffly resilient housings capable of absorbing some impact-created forces. It has been found that, in spite of all previous precautions, the internal components of prior portable air blowers invariably eventually become tweaked or misaligned as they are repeatedly subjected to jarring, impact-created shock forces. Such misalignment occurs partly due to the rigid nature of the mounting arrangement of the motor and blower wheel within the housing, which often precludes the absorption or damping of these impact-created shock forces by flexion.

The result of a misorientation of the motor and/or blower wheel within the housing is the creation of undesirable vibration within the air blower. Vibration within a portable air dryer is very undesirable because it can cause the blower to bounce or walk across a hard surface. As the vibration becomes progressively worse, mechanical parts of the blower begin to wear out prematurely, which ultimately renders the air blower unusable.

There exists, therefore, a significant need for a portable air blower having means for mounting the motor and the blower wheel within the housing in a manner permitting limited and temporary flexion of the motor and the blower wheel with respect to the housing when the air blower is subjected to impact-created shock forces. Additionally, a portable air blower having such a mounting arrangement is needed which returns the motor and the blower wheel to a preferred position within the housing immediately following and in the absence of shock forces. Such an improved mounting arrangement should be compatible with standard portable air blower design and result in no degradation in the capability of such air blowers. Further, a novel mounting arrangement is needed which is relatively inexpensive, durable and reliable. An arrangement utilizing similar parts for mounting each end of the blower means, or motor and blower wheel assembly, within the housing would be preferred. The present invention fulfills these needs and provides further related advantages.

SUMMARY OF THE INVENTION

The present invention resides in a vibration and shock damping portable air blower which satisfies the needs set forth above. The air blower comprises, generally, a flexibly resilient housing having separate air intake means and air exhaust means, and blower means within the housing for drawing air into the housing through the air intake means and blowing the air out of the housing through the air exhaust means. First blower support means are provided for mounting a first end of the blower means to a first end of the housing in a manner permitting resilient flexion of the blower means with respect to the first housing end. Similarly, second blower support means are provided for mounting a second end of the blower means to a second end of the housing in a manner permitting resilient flexion of the blower means with respect to the second housing end. The first and second blower support means cooperatively support the blower means within the housing in a manner permitting limited and temporary flexion of the blower means with respect to the housing when the air blower is subjected to impact-created shock forces.

In a preferred form of the invention, the flexibly resilient housing includes a first end, a second end, air intake means situated adjacent to both the first and second ends, and a separate air exhaust means. The blower means includes a motor having a motor body and a rotatable shaft extending therefrom, and a generally cylindrical fan having a plurality of blades arranged for rotation about the motor. The cylindrical fan includes a central web portion having a blower wheel support block which is placed over and anchored to a portion of the motor shaft. When the blower wheel support block is fixed to the motor shaft, rotation of the shaft causes a like rotation of the fan.

A rigid motor mounting bracket is fixed to an end of the motor housing opposite the motor shaft. Means are provided for attaching the motor mounting bracket to the housing first end in a manner permitting resilient flexion of the motor with respect to the first housing end. The motor mounting bracket attaching means includes a plurality of first shock mounts which each comprises a bolt, resilient elastomeric grommet means interposed between the bolt and a portion of the motor mounting bracket, and a nut for securing the bolt to the housing first end.

Means are also provided for supporting the motor shaft, which motor shaft supporting means cooperates with the motor mounting bracket attaching means to support the blower means within the housing in a manner permitting limited and temporary flexion of the blower means with respect to the housing when the air blower is subjected to impact-created shock forces. The motor shaft supporting means includes a flexibly resilient support bracket having a head located generally adjacent to an end of the motor shaft, and a plurality of resiliently flexible support legs which extend from the bracket head in a pyramid-like configuration toward the housing second end. The support legs are each attached to the housing second end by a respective second shock mount which includes a bolt, a resilient elastomeric grommet means interposed between the bolt and a portion of the respective support leg, and a nut for securing the bolt to the housing second end.

A self-aligning bearing is situated on the bracket head for supporting the end of the motor shaft in a manner permitting rotation thereof relative to the motor shaft supporting means. The self-aligning bearing provides a release for stress and bending forces upon the motor shaft during multi-directional non-parallel flexing of the support legs. In this arrangement, radial deflection of the motor shaft is permitted to absorb energy and cushion the blower means.

This structure permits the blower means within the housing to flex in five distinct ways in response to impact-created shock forces. More particularly, due to the flexibly resilient nature of the housing, the bolt of each first shock mount is permitted to move with respect to its normal orientation by flexion of the housing. Secondly, the motor mounting bracket is permitted to flex, via the grommet means, with respect to the first shock mount bolts. Thus, the attachment between the motor and the housing is provided with two primary means of flexion. At the other end of the housing the bolts of the second shock mounts are similarly permitted to move or flex by movement or flexion of the housing itself. The bolts of both the first and second shock mounts pivot in any direction in a controlled full floating manner within the grommet means and then return to a normal orientation, thereby functioning as a torsion arm system that absorbs kinetic energy. The resiliently flexible support legs flex with respect to the second shock mounts via the grommet means provided therein. This is similar to the arrangement provided at the first end of the housing. In addition, however, the flexibly resilient support bracket is constructed to inherently provide further flexion in response to impact-created shock forces.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 6 is another illustration of the second shock mount and support bracket of FIG. 4, showing how the configuration of the second shock mount will change to absorb side-to-side movement of the support bracket;

FIG. 7 is another illustration similar to FIGS. 4 and 6, showing how the configuration of the second shock mount changes as it absorbs downward movement of the support bracket;

FIG. 8 is an additional illustration similar to FIGS. 4, 6 and 7, showing how the configuration of the second shock mount changes as it absorbs upward movement of the support bracket; and FIG. 9 is still another illustration similar to FIGS. 4, and 6–8, showing how the configuration of the second shock mount changes as it absorbs angular movement of the support bracket.

DETAILED DESCRIPTION OF THE PREFERRED EMBODIMENT

Figure 1:
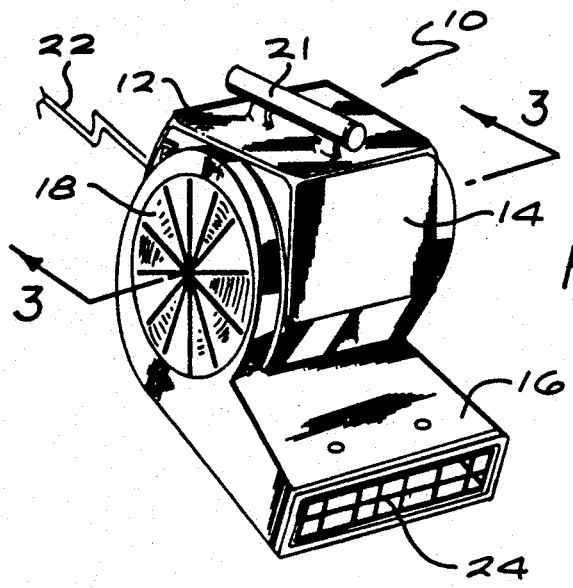
FIG. 1 is a perspective view of a vibration and shock damping air blower embodying the invention.
Figure 2:
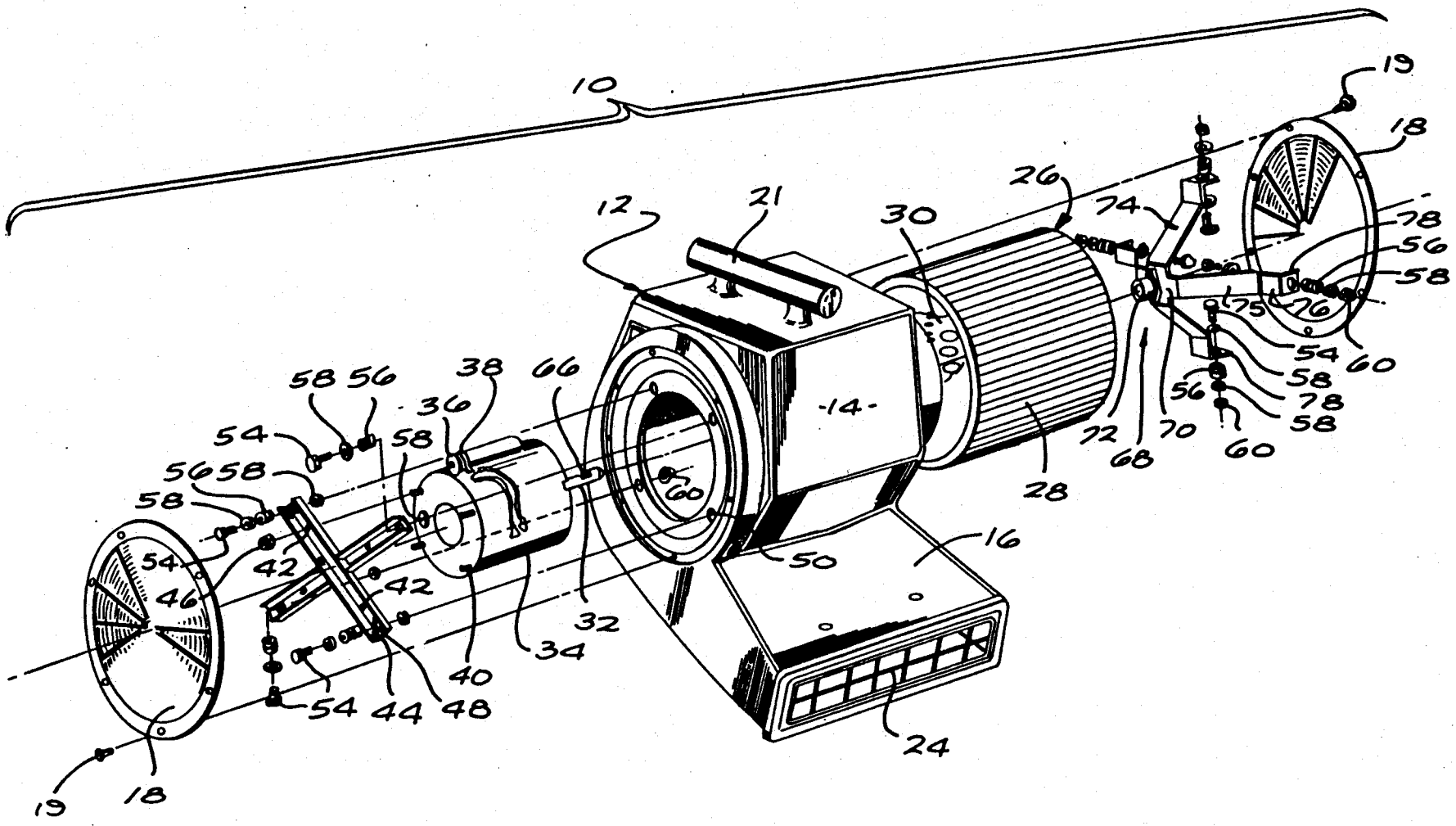
FIG. 2 is an exploded assembly view of the air blower shown in FIG. 1, illustrating a housing for the air blower and its internal components.
Figure 3:
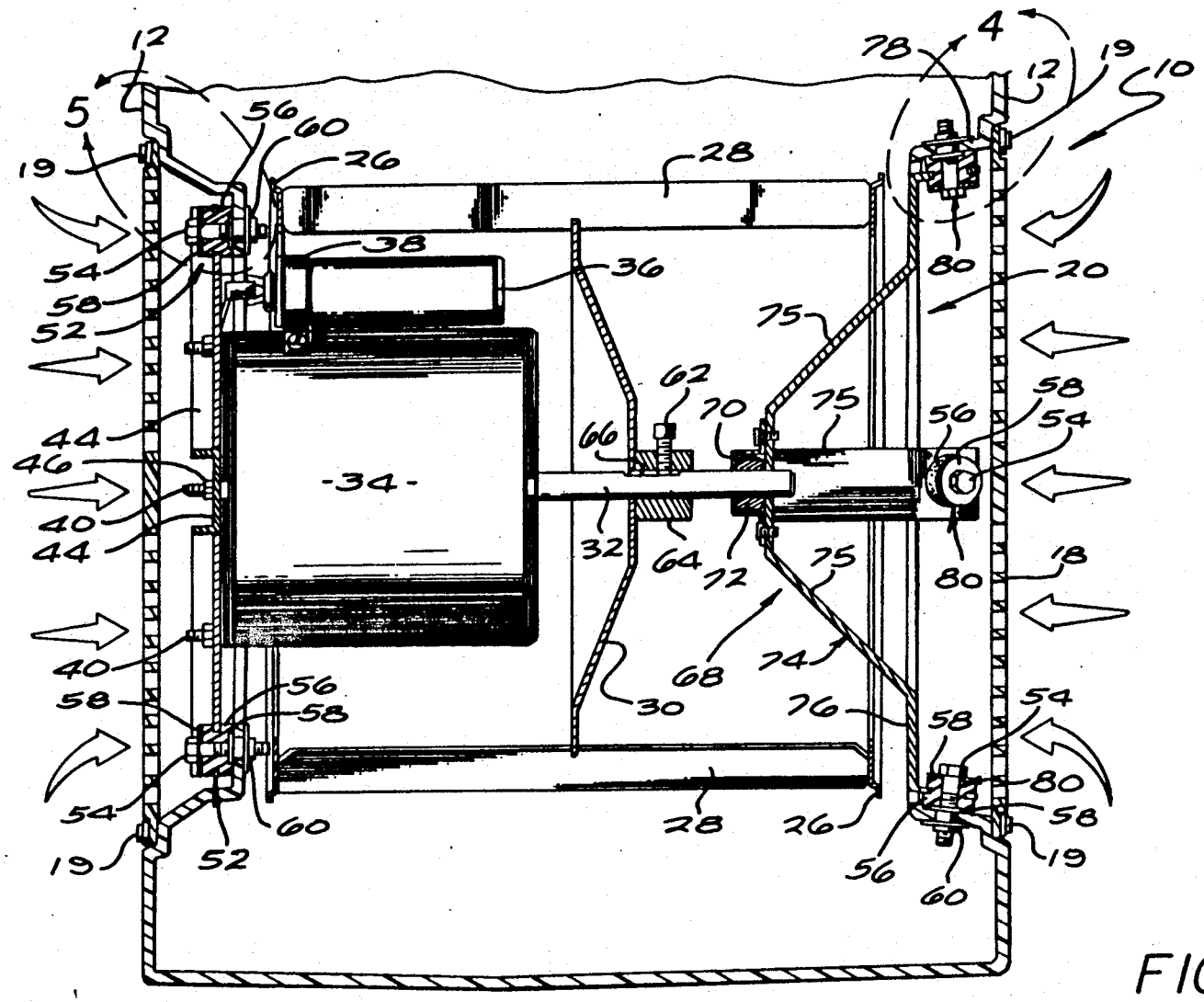
FIG. 3 is an enlarged, fragmented cross-sectional view taken generally on line 3—3 of FIG. 1, illustrating the assembled configuration of parts within the air blower housing.

As shown in the drawings for purposes of illustration, the present invention is concerned with a vibration and shock damping air blower, generally designated in FIGS. 1 through 3 by the reference number 10. The focus of the invention is an improved mounting arrangement for supporting blower means within a flexible blower housing in a manner wherein the mounting arrangement and the flexible housing cooperatively absorb impact-created shock forces which previously tended to deform internal components of the air blower. The present invention advantageously prevents or minimizes such deformation and thus minimizes the chance that moving blower components will become misaligned and create undesirable vibration.

The air blower 10 of the present invention includes an outer housing 12 having a main body portion 14 suitably sized for housing blower means therein, and a nozzle portion 16 for directing air blown from the housing 12 by the blower means. The main body portion 14 is provided with one or more air intake grills 18 attached by screws 19 to cover respective housing openings 20 (FIG. 3), a handle 21, and an access aperture (not shown) for a power cord 22 that connects the blower means to a suitable power source. The nozzle portion 16 has an open end covered by an exhaust grill 24, that is in fluid communication with the blower means.

The blower means includes a blower wheel 26 (FIGS. 2 and 3) having of a plurality of parallel fan blades 28 arranged in a cylindrical configuration. The blower wheel 26 also has a central support web 30 adapted for attachment to a motor shaft 32 having one end which is rotatably driven by an electric motor 34 (illustrated with a capacitor 36 secured thereto by a strap 38). Rapid rotation of the blower wheel 26 by the motor 34 draws in air through the air intake openings 20, and expels air out of the housing through the nozzle 16 and past the exhaust grill 24.

The foregoing discussion of the housing and blower means is directed to aspects of the present invention which are deemed to be conventional. It is to be understood that although the present invention is illustrated and described in the environment of a squirrel cage fan air blower, it also has utility in air blowers having different blower wheels or other arrangements of motors and blower wheels.

Figure 5:
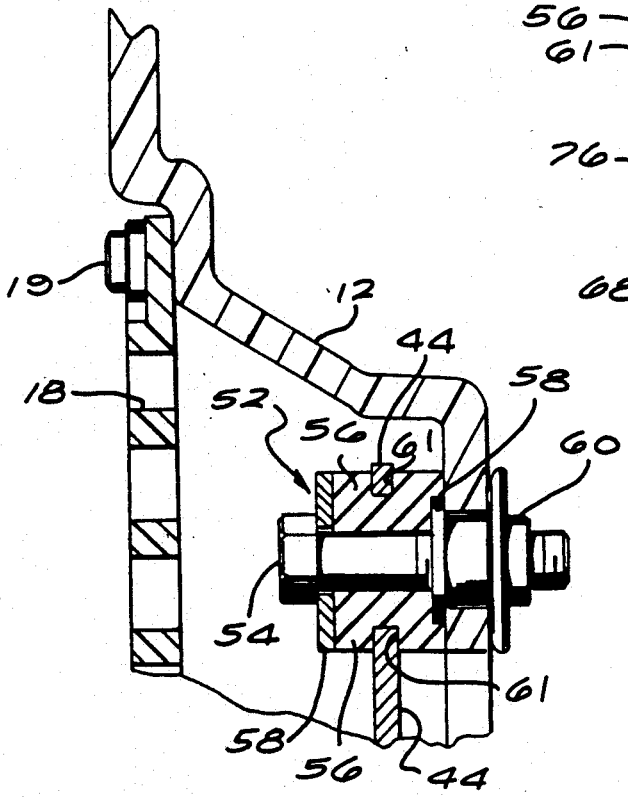
FIG. 5 is an enlarged, fragmented and partially cross-sectional view taken generally of the area designated by the circle 5 in FIG. 3, illustrating the manner in which a first shock mount attaches a motor mounting bracket to the housing.

In accordance with the present invention, the motor 34 includes a plurality of motor mounting studs 40 which are secured within first apertures 42 in a motor mounting bracket 44 by lock nuts 46. The motor mounting bracket 44 includes second apertures 48 that are aligned with apertures 50 in the outer housing 12 (FIG. 2). The motor mounting bracket 44 is attached to the outer housing 12 by a plurality of first shock mounts 52, each of which includes a hex bolt 54 having a resilient, elastomeric grommet 56 disposed about its shank between two washers 58, and a corresponding self-clinching nut 60 (FIG. 5). The grommet 56 of each shock mount 52 fits snugly within the second aperture 48 in the motor mounting bracket 44 such that the hex bolt 54 passing through the grommet 56 does not directly contact the motor mounting bracket 44. In this manner, the grommets 56 provide a resilient cushion around the shank of the hex bolts 54. To ensure that the grommet 56 will remain captured within its respective second aperture 48, each grommet is provided with a circumferential slot 61 about its midsection which receives a portion of the motor mounting bracket 44 surrounding the respective second aperture 48.

The grommets 56 serve as means for allowing flexion of the motor mounting bracket 44 with respect to the bolts 54. Construction of the housing 12 also preferably permits flexion of the bolts 54 with respect to the housing 12. More specifically, the bolts 54 function as a torsion arm system by pivoting relative to the housing 12 in any direction in a controlled full floating manner within their respective grommets 56 in response to impact-created shock forces. Thus, flexion of the motor mounting bracket 44 with respect to the bolts 54 through the grommets 56, and flexion of the bolts 54 with respect to the housing 12, cooperatively serve to absorb impact-created shock forces which could jar the motor and possibly deform the mounting arrangement.

The motor shaft 32 passes through a central aperture in the central web 30 of the blower wheel 26, and is clamped thereto by a lock nut 62. The lock nut 62 is threaded through a blower wheel support block 64 provided by the central web 30. The shaft 32 includes a slot 66 that provides a flat surface which the lock nut 62 engages when fully tightened.

The end of the shaft 32 opposite the motor 34 protrudes beyond the central web 30 of the blower wheel 26 and is supported by a flexibly resilient motor shaft support bracket 68. As best viewed in FIGS. 2 and 3, the motor shaft support bracket 68 includes a head portion 70 having an aperture therethrough for receiving the motor shaft 32, and a self-aligning bronze bearing 72 affixed to the head portion 70 adjacent to the aperture for supporting the shaft 32 in a manner permitting rotation of the shaft 32 with respect to the support bracket 68. The self-aligning bearing 72 accommodates radial deflection of the motor shaft 32, thereby damping stress and vibrational forces upon the motor shaft.

Four flexible support legs 74 extend angularly away from the head portion 70. These support legs are configured in a pyramid-like arrangement and are integrally formed with the head portion 70. The support legs 74 include an upper portion 75 and a lower portion 76 which lies in a plane parallel to the plane of the head portion 70. Each leg 74 also includes a foot 78 that lies in a plane generally perpendicular to the plane of the head portion 70. The flexibly resilient nature of the motor shaft support bracket 68 provides a plurality of flexion points whereby impact-created shock forces upon the housing 12 can be absorbed or damped by a flexing action of the support bracket 68.

Figure 4:
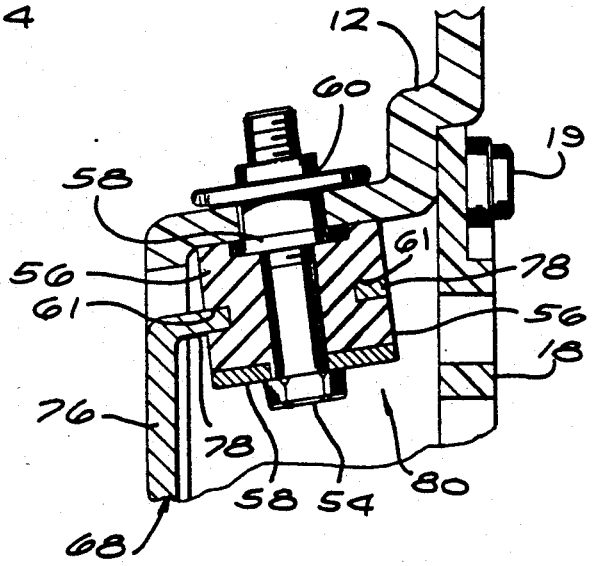
FIG. 4 is an enlarged, fragmented and partially cross-sectional view taken generally of the area designated by the circle 4 in FIG. 3, illustrating the manner in which a second shock mount attaches a motor shaft support bracket to the housing, and also showing the normal configuration of a shock mount in the absence of shock forces.

Additional flexion points for damping vibration and shock forces are provided by the use of second shock mounts 80 to attach the motor shaft support bracket 68 to the housing 12. As best viewed in FIG. 4, the second shock mounts 80 are identical to the first shock mounts 52 previously described, and each includes a resilient elastomeric grommet 56 disposed between two washers 58 on the shank of a hex bolt 54 which is secured to the housing 12 by a self-clinching nut 60. Each foot 78 of the motor shaft support bracket 68 contains an aperture which accommodates the grommet 56 of the second shock mount 80 in a snug fit. As can be seen in FIGS. 4 and 5, both the motor mounting bracket 44 and the motor shaft support bracket 68 grip the grommets 56 about their circumferential slots 61 to capture the grommets 56 in place. This prevents the grommets from working themselves free from the grommet-accommodating apertures in both brackets 44 and 68.

The use of the second shock mounts 80 to attach the motor shaft support bracket 68 to the housing 12 enables the grommets 56 to function as means for allowing flexion of the support bracket 68 with respect to the hex bolts 54. FIGS. 6 through 9 illustrate various ways in which the resiliency of the grommets 56 permits flexion of the support bracket 68 with respect to the hex bolts 54. The first shock mounts 52 permit flexion of the motor mounting bracket 44 with respect to the hex bolts 54 in a manner similar to the action of the second shock mounts 80 depicted in FIGS. 6 through 9. The flexion points provided by the grommets 56 enable the motor shaft mounting arrangement to withstand impact forces and absorb vibration and impact-created shock forces by flexion so that permanent deformation of the mounting components is prevented. The resiliency of the elastomeric grommets 56 ensures that the mounting components return to their original orientation following flexion.

A feature of the present invention which further enhances the vibration and shock damping capability of the air blower 10 is the use of a flexibly resilient outer housing 12 which can temporarily flex to absorb impact forces and then resiliently return to its original shape. Preferably, the outer housing 12 is comprised of a polyethylene material. The flexing action provided by the flexible outer housing 12 serves to dissipate and absorb impact forces before such forces are transferred to components within the housing. Moreover, the bolts 54 of the second shock mounts 80 flex relative to the housing 12 to further help dissipate and absorb impact forces.

The shock damping air blower 10 provides a multi-directional energy absorbing flexation system which has six progressive levels of shock resistance that are available to supply the damping effect required. One level of damping is provided by multi-directional flexion of the first and second shock mounts 52 and 80, which absorb the initial shock upon the blower. Another level of shock damping is provided by flexion of the motor shaft support bracket 68. The self-aligning bearing 72 between the motor shaft and the motor shaft support bracket provides a third level of damping which compensates for multi-directional, non-parallel flexing of the support legs 74. Radial deflection of the motor shaft 32 provides a fourth level of shock damping. A fifth level of energy absorption is provided by the flexible plastic housing 12, and finally, the action of the hex bolts 54 as a torsion arm system provides the sixth level of shock damping, wherein the hex bolts 54 can pivot relative to the housing 12 in a controlled full-floating manner within the grommets 56.

The energy absorption system of the present invention also functions in reverse in the sense that when vibrations are created internally by, for example, out of balance blower components, the system will dampen vibration transfer between the internal blower components and the outer housing. This feature advantageously prevents the air blower from "walking" or bouncing when placed on hard surfaces, a long-standing problem in the industry.

From the foregoing, it will be appreciated that the vibration and shock damping air blower of the present invention advantageously provides flexion points at first and second shock mounts, at a flexible motor shaft support bracket, and at attachment locations between mounts for the blower means and the flexibly resilient blower housing. This permits the air blower to absorb vibration and shock forces by flexing at these flexion points. The result is an improved air blower which is substantially impact-damage resistant.

While a particular form of the invention has been illustrated and described, it will be apparent that various modifications can be made without departing from the spirit and scope of the invention. Accordingly, it is not intended that the invention be limited, except as by the appended claims.

We claim:

1. An air blower, comprising:

a flexibly resilient housing having separate air intake means and air exhaust means;

blower means within the housing for drawing air into the housing through the air intake means and blowing the air out of the housing through the air exhaust means, the blower means including a motor having a motor body and a rotatable shaft extending therefrom, and fan means supported by the shaft;

first blower support means for mounting a first end of the blower means to a first end of the housing in a manner permitting resilient flexion of the blower means with respect to the first housing end, the first blower support means including a plurality of first shock mounts, each first shock mount comprising a bolt, resilient elastomeric grommet means disposed about a shank of the bolt, and a nut for securing the bolt to the housing; and second blower support means for mounting a second end of the blower means to a second end of the housing in a manner permitting resilient flexion of the blower means with respect to the second housing end, the second blower support means including a flexibly resilient support bracket having a head portion for supporting the second end of the blower means, a plurality of support legs extending from the head portion for attachment to the housing second end, and a plurality of second shock mounts for connecting the flexible support legs to the housing second end, each of the second shock mounts including a bolt, resilient elastomeric grommet means interposed between the bolt and a respective one of the support legs, and a nut for securing the bolt to the housing second end;

wherein the first and second blower support means cooperatively support the blower means within the housing in a manner permitting limited and temporary flexion of the blower means with respect to the housing when the air blower is subjected to impact-created shock forces, and return the blower means to a preferred position within the housing immediately following and in the absence of such shock forces.

2. An air blower as set forth in claim 1, wherein the first blower support means includes a rigid motor mounting bracket bolted directly to an end of the motor body opposite the shaft, which motor mounting bracket is, in turn, mounted to the housing first end through attachment to the first shock mounts.

3. An air blower as set forth in claim 2, wherein the motor mounting bracket engages each of the first shock mounts in a manner generally surrounding a portion of each grommet means, so that the grommet means is interposed between the bolt and the motor mounting bracket.

4. An air blower as set forth in claim 1, wherein the head portion of the second blower support means supports a self-aligning bearing, which bearing receives and supports therein an end of the motor shaft.

5. An air blower, comprising:

a flexibly resilient housing having a first end, a second end, and separate air intake means and air exhaust means;

blower means within the housing for drawing air into the housing through the intake means and blowing it out of the housing through the air exhaust means, the blower means including a motor having a motor body and a rotatable shaft extending therefrom, and a generally cylindrical fan having a plurality of blades arranged for rotation about the motor, and a central web portion, wherein the central web portion includes a blower wheel support block which is placed over and anchored to a portion of the motor shaft so that rotation of the shaft causes a like rotation of the fan;

a rigid motor mounting bracket fixed to an end of the motor body opposite the motor shaft;

means for attaching the motor mounting bracket to the housing first end in a manner permitting resilient flexion of the motor with respect to the first housing end, the motor mounting bracket attaching means including a plurality of first shock mounts which each comprises a bolt, resilient elastomeric grommet means interposed between the bolt and a portion of the motor mounting bracket, and a nut for securing the bolt to the housing first end;

means for supporting the motor shaft, which motor shaft supporting means cooperates with the motor mounting bracket attaching means to support the blower means within the housing in a manner permitting limited and temporary, flexion of the blower means with respect to the housing when the air blower is subjected to impact-created shock forces, but returning the blower means to a preferred position within the housing immediately following and in the absence of such shock forces, the motor shaft supporting means including a flexibly resilient support bracket having a head located generally adjacent to an end of the motor shaft for engaging the motor shaft, a plurality of resiliently flexible support legs extending from the bracket head in a pyramid-like configuration toward the housing second end, and a plurality of second shock mounts, at least one of such second shock mounts being associated with each of the support legs, wherein each second shock mount includes a bolt, a resilient elastomeric grommet means interposed between the bolt and a portion of the respective support leg, and a nut for securing the bolt to the housing second end; and self-aligning bearing means situated on the bracket head, for directly supporting the end of the motor shaft in a manner permitting rotation thereof relative to the motor shaft supporting means.

6. An air blower, comprising:

a flexibly resilient housing having first vent means and second vent means;

blower means mounted within the housing in fluid communication with the first and second vent means, the blower means comprising motor means and a blower wheel having a plurality of fan blades, the blower wheel being attached to a rotatable shaft having a first end driven by the motor means;

first blower support means for attaching the motor means to a first end of the housing in a manner permitting resilient flexion of the blower means with respect to the first housing end, the first blower support means including bracket means associated with the motor means, and at least one first shock mount comprising a bolt, resilient elastomeric grommet means interposed between the bolt and the bracket means, and a nut for securing the bolt to the housing first end; and second blower support means for supporting a second end of the rotatable shaft with respect to a second end of the housing in a manner permitting resilient flexion of the blower means with respect to the second housing end;

wherein the first and second blower support means cooperatively support the blower means within the housing in a manner permitting limited and temporary flexion of the blower means with respect to the housing when the air blower is subjected to impact-created shock forces, but return the blower means to a preferred position within the housing immediately following such shock forces.

7. An air blower as set forth in claim 6, wherein the bracket means includes a rigid motor mounting bracket fixed to an end of the motor means opposite the rotatable shaft.

8. An air blower as set forth in claim 6, wherein the blower wheel includes a central web portion having a blower wheel support block which is placed over and anchored to a portion of the rotatable shaft so that rotation of the shaft causes a like rotation of the blower wheel.

9. An air blower as set forth in claim 6, wherein the second blower support means includes a resiliently flexible support bracket having a head portion for supporting the second end of the rotatable shaft, and means extending from the head portion for attachment to the housing second end.

10. An air blower as set forth in claim 9, wherein the support bracket includes a plurality of resiliently flexible support legs extending from the bracket head in a pyramid-like configuration, for attachment to the housing second end.

11. An air blower as set forth in claim 10, wherein the support bracket includes a plurality of second shock mounts, at least one of such second shock mounts being associated with each of the support legs, wherein the second shock mounts each include a bolt, a resilient elastomeric grommet means interposed between the bolt and a portion of the respective support leg, and a nut for securing the bolt to the housing second end.

12. An air blower as set forth in claim 9, including self-aligning bearing means situated on the head portion of the support bracket, for directly supporting the second end of the rotatable shaft in a manner permitting rotation thereof relative to the support bracket.

13. An air blower as set forth in claim 6, wherein the first vent means comprises air intake vents situated generally adjacent to the housing first and second ends, and wherein the second vent means comprises an air exhaust vent intermediate the air intake vents.

14. An air blower as set forth in claim 13, including protective grills for covering the first and second vent means.

* * * * *